United States Patent [19]

Alderson

[11] Patent Number: 5,070,670

[45] Date of Patent: Dec. 10, 1991

[54] ROOF PANEL ATTACHMENT SYSTEM

[76] Inventor: W. Howard Alderson, 24 Jessen Ct., Kensington, Calif. 94707

[21] Appl. No.: 448,666

[22] Filed: Dec. 11, 1989

[51] Int. Cl.[5] ..... E04D 1/34; E04D 11/02

[52] U.S. Cl. ..... 52/410; 52/420

[58] Field of Search ..... 52/478, 789, 420, 410

[56] References Cited

U.S. PATENT DOCUMENTS 3,408,786 11/1968 Snyker ..... 52/420
4,128,984 12/1978 Charbonneau ..... 52/478
4,736,552 4/1988 Ward ..... 52/478
4,831,799 5/1989 Glover ..... 52/789

FOREIGN PATENT DOCUMENTS 747341 11/1966 Canada .

*Primary Examiner*—John E. Murtagh
*Attorney, Agent, or Firm*—Limbach, Limbach & Sutton

[57] ABSTRACT

A roof panel attachment system is disclosed herein. The invention includes a roof substrate and a rigid roof panel or a plurality of such panels. The roof substrate is attached to the roof panels and the roof panels are attached to one another utilizing double backed foam adhesive tape.

6 Claims, 2 Drawing Sheets

ROOF PANEL ATTACHMENT SYSTEM

BRIEF DESCRIPTION OF THE INVENTION

This invention relates generally to roof panel attachment systems. More particularly, it relates to a sheet metal roof panel attachment system utilizing double backed foam adhesive tape.

BACKGROUND OF THE INVENTION

Sheet metal roof panels are well-known in the art. They are typically attached in a manner similar to that utilized for wooden, slate, or asphalt shingles. That is, the individual panels are placed in an overlapping configuration, the overlapping region is then nailed down to the roof substrate.

This system, while suitable for wooden, slate or asphalt shingles, results in a number of difficulties when applied to sheet metal roof panels. For one, sheet metal roof panels are usually larger than shingles. As a result, high winds tend to generate a strong uplift on the panels. Given this tendency, an especially strong physical connection is required between the sheet metal panels and the roof substrate.

When high winds do in fact uplift sheet metal panels, there is a displacement of the nails used to connect the panels to the roof. The displacement of these elements destroys the seal between the elements. As a result, moisture passes through the holes left by the nails. This moisture tends to cause rotting of the roof substrate while also inducing the panels to rust.

A related problem stems from the fact that the rigid connection between the roof, the sheet metal panels and the nails expands and contracts under the extreme temperature variations experienced on a roof. This is primarily a consequence of the relatively high thermal coefficient of expansion of metal compared to wood. Since the connection between these elements is not yielding in nature, the connection often fractures and is otherwise subject to displacement. Again, moisture migrates beneath the sheet metal panels and therefore weakens the roof structure while promoting the rusting of the roof panels.

The prior art has attempted to avoid some of these problems by using liquid cement to bind sheet metal panels to the roofing substrate. However, this approach is problematic insofar as it involves the labor-intensive activity of applying the liquid cement. In addition, since the drying time of the bonding materials varies greatly with weather conditions, a great deal of time is spent waiting for the bonding material to approach an appropriate state. Occasionally, bonding is attempted at inappropriate times, resulting in inferior bonding characteristics. Moreover, liquid cements are generally rigid and non-elastic.

In the prior art, roofing paper is commonly utilized in order to facilitate roof replacement and removal. That is, the roofing paper shears upon removal of the roof and leaves a clean surface which can be immediately used for installation of a new roof. Application of roofing paper is a discrete step in the process of building a roof. As such, it is time consuming and expensive.

OBJECTS AND SUMMARY OF THE INVENTION

It is a general object of the present invention to provide an efficient metal roof panel attachment system.

A related object of the present invention is to provide a strong roof panel attachment system which is capable of withstanding the uplift produced by high winds.

A further related object of the present invention is to provide a roof panel attachment mechanism with sealing characteristics to allow minimal rusting of the sheet metal panels.

Another object of the present invention is to provide a roof panel attachment system which can be easily and instantaneously applied in a variety of weather conditions.

A related object of the present invention is to provide a roof panel attachment mechanism which obviates the need for roofing paper.

Still another object of the present invention is to provide a roof panel attachment system which withstands moisture accumulations beneath the panels and the deterioration of the roof structure associated with accumulated moisture.

Yet another object of the present invention is to provide a yielding roof panel attachment system which is not vulnerable to the problems associated with the expansion and contraction of roofing elements under the extreme temperature variations experienced on a roof.

It is still a further object of the present invention to provide a metal roof attachment system which prevents those problems inherent in a flat roof where standing water may accumulate.

The foregoing and other objects are achieved by a roof panel attachment system which includes a roof substrate and a rigid roof panel member. The roof substrate and the rigid roof panel member are secured to one another by double backed foam adhesive tape.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit an scope of the invention as defined by the appended claims.

DETAILED DESCRIPTION OF THE INVENTION

Figure 1:
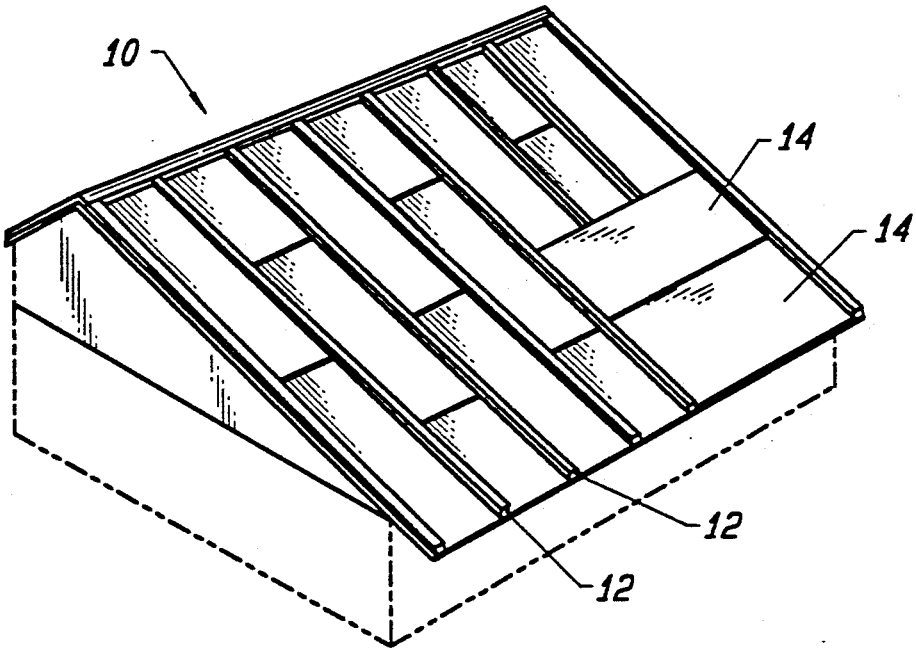
FIG. 1 is a perspective view of a roof substrate which includes rafters and board members.

Turning now to the drawings, wherein like components are designated by like reference numerals in the various figures, attention is initially directed to FIG. 1. The figure depicts a roof substrate 10. The roof substrate 10 may include either rafters 12 or it may include one or more board members 14. The rafters 12 and the board members 14 may be of any such material commonly employed in the art. For instance, they may be unpainted wood or painted wood, sheet metal as in mobile homes, a plastic moisture barrier, a radiation barrier, or roofing paper. Alternatively, they may constitute metal strips, painted or unpainted, galvanized or ungalvanized.

In the prior art, sheet metal panels would be placed in an overlapping configuration on the roof substrate 10. Along the roof substrate 10 perimeter and in the regions of overlapping panels, the prior art utilized nails or liquid cement to attach the sheet metal panels to the roof substrate 10. Alternatively, metal sheets with raised vertical direction edges held down by clips with caps also held down by clips have been used. This allows for thermal expansion and contraction in a vertical direction. In this configuration, the roof was required to be sloped with full length vertical sheets employed.

As previously discussed, these prior art techniques resulted in a number of problems. To overcome these deficiencies, one must successfully integrate a number of relatively contradictory properties. For instance, one must have a strong bond between the roof substrate and the sheet metal panel to diminish the danger of uplift from strong winds. On the other hand, this bond should be yielding in order to allow for the expansion and contraction of roofing elements which are exposed to extreme temperature variations. While the bond should be strong, yet yield for expansion and contraction, the yielding portion of the bond should preferably shear upon removal of the roof to avoid the necessity of roofing paper. Finally, the attachment system should be one which is conveniently applied, yet provides for sealing against moisture so as to eliminate rusting and degradation to the roofing substrate.

Selection of a medium to satisfy these parameters has heretofore been unsuccessful. However, the novel and nonobvious roof attachment of the present invention successfully incorporates these disparate characteristics.

Figure 2:
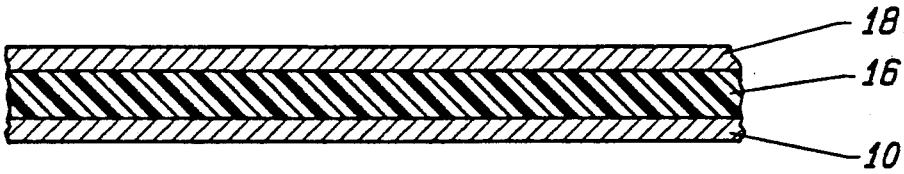
FIG. 2 is a cross-sectional, side elevational view of a roof substrate, double backed adhesive tape and a rigid panel.

The invention herein is most fully appreciated with reference to FIG. 2. The figure depicts a cross-sectional, side elevational view of a roof substrate 10. Positioned on top of the roof substrate 10 is double backed adhesive tape 16.

The properties of a carefully selected double backed adhesive tape 16 are ideal for overcoming the problems associated with sheet metal roofs. For one, an appropriate tape provides a large degree of mechanical strength. This feature eliminates the necessity for nails and the vulnerability to uplift produced by high winds. By eliminating the nails, one eliminates holes in the sheet metal panels and the rusting and moisture accumulations associated therewith. Similarly, a proper tape will actually provide an additional seal against moisture.

Still other characteristics of a properly chosen tape will provide benefits not known in the prior art. A proper tape will flexibly yield to the expansion and contraction of the roofing elements. Further, a proper tape will be chemically stable. Finally, a proper tape will allow for easy application of roofing panels, and the foam portion will shear upon removal of roofing panels, thereby eliminating the need for roofing paper.

A number of pressure sensitive double sided adhesive tapes are commercially available. Such tapes include those made from asphalt base, asphalt-butamer mixtures, butamers, polyisobutylene, polyurethane and polyethylene foam materials.

Double sided asphalt base tapes have characteristics of plastic. Thus, they provide for only minimal expansion and contraction under extreme temperature conditions. Moreover, they form an inferior bond which is susceptible to water leakage.

Double sided tapes made from asphalt-butamer mixtures generally result in high density tapes which display very little thermal expansion flexibility.

Double sided tapes formed from butamers also have the characteristics of plastic. Consequently, they suffer from the same deficiencies as asphalt base tapes.

Double sided tapes formed from polyisobutylene represent a synthetic rubber. As such, they are of a high density and too rigid to allow for appreciable thermal expansion flexibility.

Polyurethane foam double sided tapes are of a lower density than the aforementioned tapes, approximately 15 lbs/cu. foot. Although an improvement, this density still does not allow for ideal thermal expansion characteristics. Furthermore, as a result of this relatively high density, polyurethane tapes are expensive.

Polyethylene foam double sided tapes represent a highly desirable embodiment. Preferably, the polyethylene foam is a closed-cell copolymer which is flexible at low temperatures and stable at high temperatures. As such, it should be resistant to weathering, oxidation, and some ultraviolet exposure. However, the tape is always covered by sheet metal, and is never exposed to ultraviolet light. Each side of the tape is preferably covered with a pressure-sensitive acrylic adhesive.

Other preferable properties of the tape are as follows. The density should be approximately 2 to 6 lbs/cu. foot. Water absorption should be approximately 0.4% by weight. To compress the tape by 25%, approximately 6.5 psi should be required while the tape should have a tensile adhesion of approximately 60 psi. Preferably, the tape will have an elongation percentage of approximately 250.

The thickness of the tape should be between 1/32 of an inch and ⅛ of an inch, preferably 1/16 of an inch. The width should be between ¼ of an inch and 6 inches, although in some applications, it may be as much as 4 feet wide.

Polyethylene foam tapes with an acrylic polymer adhesive made by Arlon Manufacturing were found to be markedly superior. In particular, Arlon 101 1/16 inch (white) tape and Arlon AGT (blue backed) have exhibited the most favorable characteristics. Arlon is a Division of Keene Corporation, located in Santa Ana, California.

This choice of material is a result of rigorous testing. Tapes made from asphalt base, asphalt-butamer mixtures, butamers, polyisobutylene, polyurethane and polyethylene foam materials were tested for mechanical strength and water sealing capability under the following circumstances.

EXAMPLE 1

Primary Sealing Test

The primary sealing test was one involving 4 feet of standing water. In this test, four foot sections of ¾ inch standard galvanized steel pipe were used. The pipes were threaded and capped on the bottom end, and a 1.5 inch horizontal slot was cut in the pipes with a hack saw, 2 inches from the bottom end of the pipe. Each slot was then taped with 3 inch sections of the above-mentioned tapes. The bottom end of the pipes were then filled with water and stored vertically which provided a four foot pressure head.

The asphalt base and polyisobutylene tapes began leaking within a month's time. The butamer and asphalt-butamer tapes began to leak shortly thereafter. However, the polyethylene foam tape exhibited no leaks after a year.

EXAMPLE 2

Mechanical Durability Test

In testing for mechanical durability, a mechanical flex-test was used. This consisted of a cam shaft with a ⅛ inch vertical travel mounted on a frame and driven by a ¼ horsepower motor connected to the cam shaft by a speed reducing belt drive such that the cam turned at 250 RPMs. Test surfaces fastened to a plate connected to a vertical rod riding on the cam were thus differentially flexed ⅛ inch compared to an opposite surface fastened to the test unit frame. A weight on top of the moving plate forced return of the plate at the bottom of the cam travel. Tests were made of painted sheet metal taped directly to plywood or to roofing papers taped to plywood.

The polyethylene foam tape displayed no significant deterioration after 15,000 cycles. Flextests were also made after patterns of freezing at 0 degree Fahrenheit and/or heating to 230 degrees Fahrenheit. Again, the polyethylene foam tape exhibited no significant deterioration after 15,000 cycles.

Thus, returning to FIG. 2, double backed foam adhesive tape 16 is applied to the roof substrate 10. Preferably, the roof substrate is clean and dry. The tape is preferably applied without stretching. Thereafter, a rigid roof panel 18 is placed on top of the tape 16. The rigid roof panel 18 is preferably sheet metal of a gauge between 24 and 28, although thick means as high as 20 gauge may be used in specific circumstances.

As the test results indicate, this configuration provides high mechanical strength to withstand the uplift effect of strong winds. Furthermore, in light of the yielding nature of the foam, wind uplift is not likely to fracture or destroy the roof attachment, a common problem in the prior art. Also, as exhibited by the test results, the configuration will provide a water impervious seal.

Figure 3:
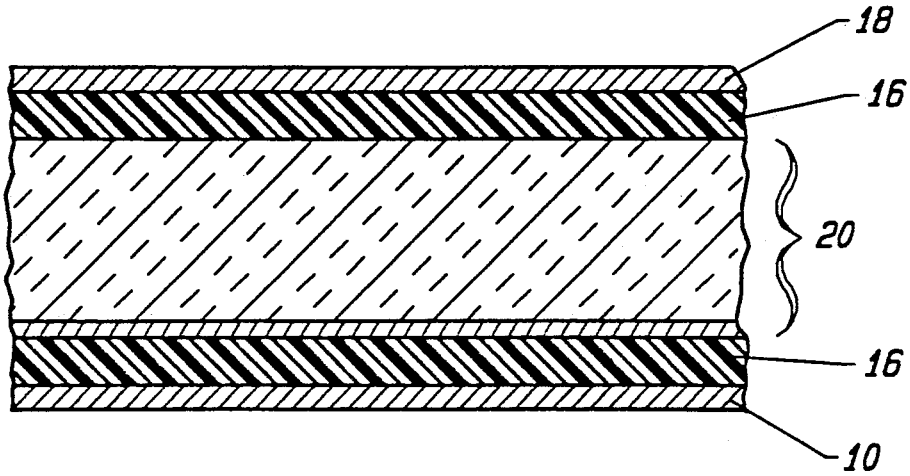
FIG. 3 is a cross-sectional, side elevational view of a roof substrate, double backed adhesive tape, intermediate member means, double backed adhesive tape, a rigid roof panel.

Turning now to FIG. 3, an alternate embodiment of the present invention is revealed. Similar to the embodiment in FIG. 1, this embodiment includes a roof substrate 10 and double backed adhesive tape 16 positioned on top of the roof substrate. However, in this embodiment, on the opposite side of the double backed adhesive tape 16 is an intermediate member means 20. The intermediate member means 20 may be a radiation barrier, a moisture barrier, roofing paper or any type of heat insulator well known in the art.

Positioned on top the intermediate member means 20 is a second layer of doubled backed adhesive tape 16. On the opposite side of the tape 16 is a rigid roof panel 18.

The adhesive tape 16 may be placed upon the roofing substrate 10 in either a horizontal or a vertical manner. The rigid roof panel 18 is then placed upon the adhesive tape 16. As can be appreciated by one skilled in the art, with the present invention, one conveniently applies the tape and then immediately applies the roof panel. Thus, the prior art obstacles associated with labor-intensive application and drying of liquid cement are avoided. Furthermore, there is no mixing of materials and thus nothing is wasted. Also, there is no special application equipment necessary and there is no clean-up involved.

Another important feature of the present invention is that the foam shears when removing the roof. That is, the acrylic polymer adhesive normally adheres to the surface to which it is attached, while the polyethylene foam shears during removal. Consequently, the tape serves the function of roofing paper, thereby dispensing of the necessity of using roofing paper.

Figure 4:
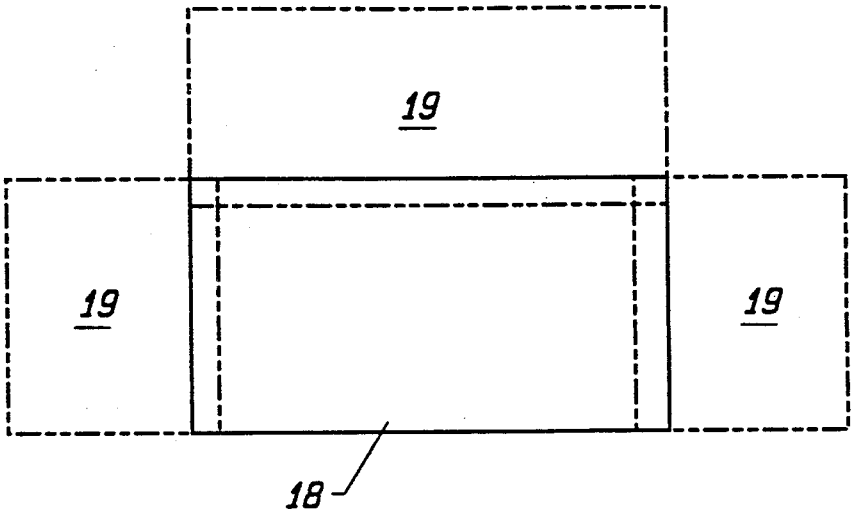
FIG. 4 plan view of a rigid roof panel including a plurality of overlapping rigid roof panels.
Figure 5:
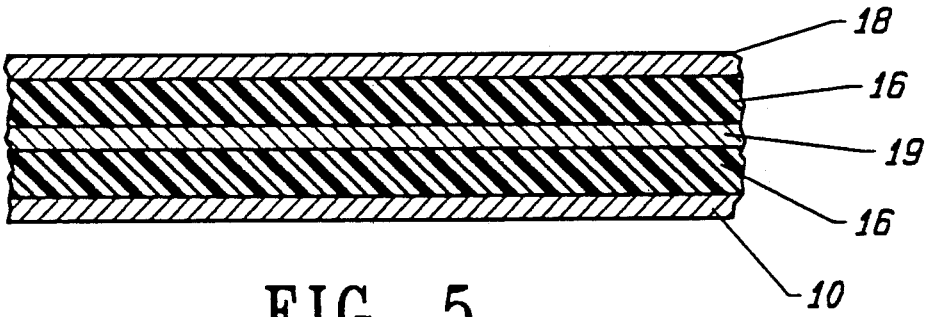
FIG. 5 is a cross-sectional, side elevational view of a roof substrate, doubled backed adhesive tape, an overlapping rigid roof panel, double backed adhesive tape and a rigid roof panel.

Preferably, the panels overlap along their perimeters or battens taped to the panel joints may be used. As depicted in FIG. 4, a roof panel 18 may be covered at its perimeter by a number of overlapping panels 19 (shown in phantom). However, unlike the prior art, instead of nailing the overlapping regions, adhesive tape 16 is placed between abutting panels, as is depicted in FIG. 5. In the Figure, a roof substrate 10 has double backed adhesive tape 16 connected thereto, on the opposite side of the tape 16 is an overlapping rigid roof panel 19, on the opposite side of the overlapping panel 19 is double backed adhesive tape 16, and on the opposite thereof is a rigid roof panel 18.

Of course, the intermediate member means 20 of FIG. 3 may be used between various elements of the overlapping configuration of FIG. 5. For instance, a water sealant intermediate member means 20 may be used between overlapping panel 19 and double backed adhesive tape 16.

While FIG. 5 depicts horizontal sheet metal panels, the concepts of the present invention are clearly applicable to overlapping panels which are corrugated, or to overlapping panels which are connected in a vertical configuration.

The particular double backed foam adhesive tape disclosed herein obviates the prior art preference for single sheets running from the top to the bottom of the roof. Moreover, it eliminates the need for a significant roof pitch for drainage since it provides a water impervious seal.

Figure 6:
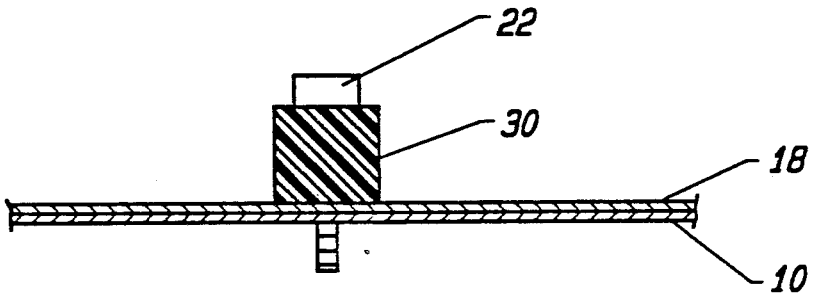
FIG. 6 is a cross-sectional, side elevational view of a roof substrate and a rigid roof panel connected by fastening means including a double backed foam adhesive tape washer.

Finally, in accordance with the concepts disclosed herein, the double sided foam adhesive may be used in conjunction with prior art methods to provide a superior vapor impervious seal. As seen in FIG. 6, a roof substrate 10 has a sheet metal panel 18 connected to it by means of a nail 22. A double sided foam tape washer 30 is positioned between the nail head and the metal panel 18.

Thus, it is apparent that there has been provided, in accordance with the invention, a roof panel attachment system, that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the appended claims.

What is claimed is:

1. A roof comprising;

(a) a roof substrate comprising rafters or board members;

(b) a plurality of exterior rigid roof panel members, forming overlapping regions;

(c) An intermediate member means positioned between said roof panel members and said substrate, wherein said intermediate member means is a moisture barrier; and (d) water impervious double-backed low density foam adhesive tape positioned, and forming a secure attachment, between said roof panel members and said intermediate member means, between said intermediate member means and said substrate, and between said overlapping regions of said roof panel members, such that said tape forms a yielding connection of high mechanical strength resistant to uplift produced by high winds and also forms a largely vapor impervious roof excluding the use of nails to avoid rusting tendencies concomitant with nail attached roofs.

2. A roof as in claim 1 wherein said tape is between 1/32 and ⅛ of an inch thick and between ¼ and six inches wide.

3. A roof as in claim 1 wherein said tape is a polyethylene foam tape.

4. A roof as in claim 3 wherein said tape has a density of approximately 2 to 6 lbs/cu. foot.

5. A roof as in claim 1 wherein said tape provides a water impervious seal.

6. A roof as in claim 5 wherein said roof has no significant pitch.

* * * * *